US009960497B2

(12) United States Patent
Han et al.

(10) Patent No.: US 9,960,497 B2
(45) Date of Patent: May 1, 2018

(54) COIL-BASED ARTIFICIAL ATOM FOR METAMATERIALS, METAMATERIAL COMPRISING THE ARTIFICIAL ATOM, AND DEVICE COMPRISING THE METAMATERIAL

(71) Applicants: SAMSUNG ELECTRONICS CO., LTD., Suwon-si (KR); CITY UNIVERSITY OF HONG KONG, Hong Kong (CN)

(72) Inventors: Seung-hoon Han, Seoul (KR); Jensen Tsan-Hang Li, Hong Kong (CN); Zixian Liang, Hong Kong (CN)

(73) Assignees: SAMSUNG ELECTRONICS CO., LTD., Suwon-si (KR); CITY UNIVERSITY OF HONG KONG, Hong Kong (CN)

( * ) Notice: Subject to any disclaimer, the term of this patent is extended or adjusted under 35 U.S.C. 154(b) by 664 days.

(21) Appl. No.: 14/385,579

(22) PCT Filed: Mar. 15, 2013

(86) PCT No.: PCT/KR2013/002079

§ 371 (c)(1),
(2) Date: Oct. 17, 2014

(87) PCT Pub. No.: WO2013/137669

PCT Pub. Date: Sep. 19, 2013

(65) Prior Publication Data

US 2015/0070245 A1 Mar. 12, 2015

Related U.S. Application Data

(60) Provisional application No. 61/611,672, filed on Mar. 16, 2012.

(30) Foreign Application Priority Data

Feb. 22, 2013 (KR) ..... 10-2013-0019372

(51) Int. Cl.
*H01Q 15/02* (2006.01)
*H01P 3/00* (2006.01)
(Continued)

(52) U.S. Cl.
CPC ..... *H01Q 15/02* (2013.01); *G10K 11/002* (2013.01); *G10K 15/00* (2013.01); *H01P 3/00* (2013.01); *H01Q 15/0086* (2013.01)

(58) Field of Classification Search
CPC .. H01Q 15/02; H01Q 15/0086; G10K 11/002; G10K 15/00; H01P 3/00
(Continued)

(56) References Cited

U.S. PATENT DOCUMENTS 6,958,729 B1 * 10/2005 Metz ..... H01P 3/08 343/700 MS
7,741,933 B2 6/2010 Duwel et al.
(Continued)

FOREIGN PATENT DOCUMENTS

CN 1866612 A 11/2006
CN 102176543 A 9/2011
(Continued)

OTHER PUBLICATIONS

Smith et al. "Metamaterials and Negative Refractive Index", Aug. 6, 2004, Science Magazine, vol. 305, pp. 788-792.*
(Continued)

*Primary Examiner* — Dameon E Levi
*Assistant Examiner* — David Lotter
(74) *Attorney, Agent, or Firm* — Sughrue Mion, PLLC

(57) ABSTRACT

Provided are an artificial atom of a metamaterial by coiling up space, a metamaterial including the artificial element, and
(Continued)

a device including the metamaterial. The artificial atom of the metamaterial by coiling up space includes a first coiling unit that coils up a first space and a second coiling unit that coils up a second space and that is connected with the first coiling unit.

29 Claims, 9 Drawing Sheets

(51) Int. Cl.
*H01Q 15/00* (2006.01)
*G10K 11/00* (2006.01)
*G10K 15/00* (2006.01)

(58) Field of Classification Search
USPC ..... 343/709
See application file for complete search history.

(56) References Cited

U.S. PATENT DOCUMENTS

| | | | | |
|---|---|---|---|---|
| 8,125,717 | B2 | 2/2012 | Sanada | |
| 8,860,631 | B2 | 10/2014 | Toujo | |
| 2009/0096545 | A1* | 4/2009 | O'Hara | H01P 7/08 332/129 |
| 2010/0007436 | A1 | 1/2010 | Sanada | |
| 2010/0259343 | A1 | 10/2010 | Toujo | |
| 2010/0265590 | A1 | 10/2010 | Bowers et al. | |
| 2011/0063716 | A1 | 3/2011 | Yamada | |
| 2011/0175795 | A1* | 7/2011 | Toujo | G02B 1/002 343/909 |
| 2012/0000726 | A1 | 1/2012 | Deymier et al. | |
| 2012/0061176 | A1* | 3/2012 | Tanielian | G10K 11/162 181/207 |
| 2012/0212395 | A1* | 8/2012 | Sanada | H01Q 15/10 343/912 |

FOREIGN PATENT DOCUMENTS

| | | | |
|---|---|---|---|
| CN | 102544739 | A | 7/2012 |
| EP | 2551960 | A1 | 1/2013 |
| KR | 10-2009-0063599 | A | 6/2009 |
| WO | 2010026907 | A1 | 3/2010 |

OTHER PUBLICATIONS

Communication dated Nov. 24, 2015, issued by the Japanese Patent Office in counterpart Japanese Application No. 2015-500364.
Zixian Liang, et al., "Extreme Acoustic Metamaterial by Coiling Up Space", Physical Review Letters, vol. 108, Mar. 16, 2012, pp. 114301-1-114301-4.
Communication from the European Patent Office dated Feb. 26, 2016 in counterpart European Application No. 13760341.1.
Jaegeun Ha, et al., "Hybrid Mode Wideband Patch Antenna Loaded With a Planar Metamaterial Unit Cell", IEEE Transactions on Antennas and Propagation, vol. 60, No. 2, February 2012, pp. 1143-1147.
M. Decker et al., "Twisted split-ring-resonator photonic metamaterial with huge optical activity", Optic Letters, vol. 35, Issue 10, Jan. 25, 2010, pp. 1-7.
Costas M. Soukoulis, "Past Achievements and Future Challenges in 3D Photonic Metamaterials", Nature Photonics, Jul. 17, 2011, pp. 1-18.
Zixian Liang et al., "Extreme Acoustic Metamaterial by Coiling Up Space", Physical Review Letters, PRL 108, 114301, Mar. 16, 2012, pp. 114301-1-114301-4.
International Search Report dated Jun. 26, 2013 issued in International Application No. PCT/KR2013/002079 (PCT/ISA/210).
Communication dated Jan. 20, 2016 issued by the State Intellectual Property Office of the P.R. China in counterpart Chinese Patent Application No. 201380025857.2.
Communication dated Feb. 20, 2017, issued by the State Intellectual Property Office of P.R. China in counterpart Chinese Application No. 201380025857.2.

* cited by examiner

COIL-BASED ARTIFICIAL ATOM FOR METAMATERIALS, METAMATERIAL COMPRISING THE ARTIFICIAL ATOM, AND DEVICE COMPRISING THE METAMATERIAL

TECHNICAL FIELD

The present disclosure relates to artificial atoms by coiling up space, metamaterials structured by an array of the artificial atoms, and devices including the metamaterials structured by an array of the artificial atoms.

BACKGROUND ART

Metamaterials are artificial materials engineered to include at least one artificial atom unit that is patterned in a random size and shape smaller than the wavelength, wherein the metamaterials are structured by an array of the artificial atom units. Each of the artificial atom units included in the metamaterials exhibits predetermined properties in response to electromagnetic waves or acoustic waves applied to the metamaterials.

Consequently, metamaterials may be provided to have any effective refractive index and effective material coefficient that are not readily observed in nature with regard to electromagnetic waves or acoustic waves. Thereby, the metamaterials give rise to many novel phenomena including subwavelength focusing, negative refraction, extraordinary transmission, invisibility cloaking, or the like.

Phenomena caused by the metamaterials also occur in photonic or phononic crystals. However, in this case, the phenomena with regard to the photonic or phononic crystals occur only near the diffraction region where operating frequencies are high. It is hard to expect an application using the effective material coefficient. That is, the size of an artificial atom is constrained not to be sufficiently small in comparison with the wavelength.

DETAILED DESCRIPTION OF THE INVENTION

Technical Problem

Provided are a coiling artificial atoms.

Provided are metamaterials including the artificial atoms.

Provided are devices including the metamaterials.

Technical Solution

According to an aspect of the present inventive concept, an artificial atom by coiling up space includes a first coiling unit that coils up a first space; and a second coiling unit that coils up a second space and that is connected with the first coiling unit.

At least one of the first and second coiling units may propagate incident waves along a zigzag path to be emitted.

Also, at least one of the first and second coiling units may be formed by connecting a plurality of channels in series where the incident waves propagate through.

Wave propagation directions of neighboring channels in the plurality of channels may be different.

Also, the neighboring channels of the plurality of channels may be separated by one plate.

The plurality of channels may be narrow in width in comparison to a wavelength of the wave.

The channel of the first coiling unit and the channel of the second coiling unit may be connected to each other in series.

The incident wave may be at least one of an acoustic wave, an electromagnetic wave, and an elastic wave.

Also, at least one of the first and second coiling units may coil up the space in at least one of two or three dimensions.

The first and second coiling units are rotationally symmetric about the point connecting the first and second coiling units to each other.

The first and second coiling units may be anisotropic.

Also, the first and second coiling units may be isotropic.

The artificial atom may also include a third coiling unit that coils up a third space and that is connected with the first and second coiling units, and a fourth coiling unit that coils up a fourth space and that is connected with the first to third coiling units.

The first to fourth coiling units may be interconnected to each other based on the center of the artificial atom.

Also, the artificial atom may be isotropic.

A refractive index of the artificial atom may be proportional to a length of the wave propagation in the artificial atom.

The refractive index of the artificial atom may be 4 or more.

At least one of an effective density and an effective bulk modulus of the artificial atom with regard to the wave of a specific frequency band may be negative.

Also, the refractive index of the artificial atom with regard to the wave of a specific frequency band may be negative.

A lattice constant of the artificial atom may be smaller than a wavelength of the wave.

The third and fourth coiling units may be rotationally symmetric about the point connecting the third and fourth coiling units to each other.

The artificial atom may further include a third coiling unit that coils up a third space and that is connected with the first and second coiling units, wherein the first to third coiling units are rotationally symmetric to each other about the center of the artificial atom, and effective wave propagation directions in each of the first to third coiling units may not exist in two dimensions.

Meanwhile, according to another aspect of the present inventive concept, a metamaterial may be formed by disposing a plurality of the artificial atoms, wherein the plurality of the artificial atoms may be formed in at least of the one dimension, two dimensions, and three dimensions.

According to another aspect of the present inventive concept, a device including the metamaterial may change characteristics of the incident wave.

According to another aspect of the present inventive concept, an artificial atom by coiling up space may include an inlet for an incident wave; an outlet for wave rejection; and a coiling unit 130 where space is coiled up and the waves move along a zigzag path toward the outlet.

In addition, the coiling unit may be formed by connecting a plurality of channels in series where the incident waves propagate through.

Also, a sum of the propagation directions of the plurality of channels may be consistent with the propagation directions from the inlet to the outlet.

A refractive index of the metamaterial structure may be proportional to a length of the pathway of the wave propagation in the coiling unit.

Effects of the Present Invention

The characteristics of waves may be changed by a coiling artificial atom.

BRIEF DESCRIPTION OF THE DRAWINGS

These and/or other aspects will become apparent and more readily appreciated from the following description of the embodiments, taken in conjunction with the accompanying drawings in which.

BEST MODE

Hereinafter, the disclosed coiled artificial atom and a metamaterial and a device including the coiled artificial atom will be described in detail with reference to the accompanying drawings.

Figure 1:
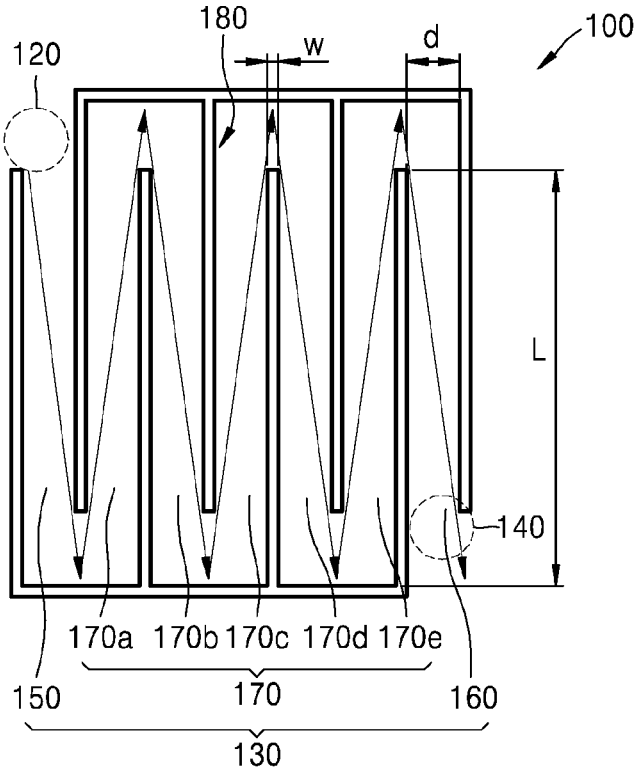
FIG. 1 is a view illustrating an artificial atom by coiling up space, according to an embodiment of the present inventive concept.

FIG. 1 is a view illustrating an artificial atom by coiling up space, according to an embodiment of the present inventive concept. Referring to FIG. 1, the artificial atom 100 includes an inlet 120 for an incident wave, an outlet 140 for wave rejection, and a coiling unit 130 where space is coiled up and the waves move along a zigzag path toward the outlet 140.

The incident waves in the artificial atom 100 may be acoustic waves. Acoustic waves may propagate within perforations of subwavelength cross sections in the absence of a cutoff frequency.

In addition, since an acoustic wave is simply a scalar field, these perforations may be further coiled up, whereas the waves may still propagate freely in the curled space.

The coiling unit 130 may coil up the space by connecting a plurality of channels in series, namely, an inlet channel 150, an output channel 160, and an intermediate channel 170. The wave propagation directions of neighboring channels may be different. However, a vector sum of the wave propagation directions in all the channels may be consistent with the wave propagation directions from the inlet 120 to the outlet 140. Also, the coiling unit 130 may coil up the space in two dimensions or three dimensions by a plurality of the channels.

For example, when the coiling unit 130 is formed of two channels, namely, the inlet channel 150 and the output channel 160, the coiling unit 130 may include the inlet channel 150 where one end thereof is connected with the inlet 120 to guide the wave propagation in a first direction, and the outlet channel 160 where one end thereof is connected with the outlet 140 to guide the wave propagation in a second direction. In addition, the coiling unit 130 may further include at least one intermediate channel 170 disposed between the inlet channel 150 and the output channel 160 to guide the wave propagation in a third direction.

The wave propagation directions of the neighboring channels may be different. However, a vector sum of the propagation directions of the waves in all the channels may be consistent with the wave propagation directions from the inlet 120 to the outlet 140. Herein, the wave propagation directions from the inlet 120 to the outlet 140 are referred to as effective wave propagation directions of the artificial atom 100. In particular, when the coiling unit 130 coils up the space in two dimensions, the wave propagation directions in odd-numbered channels based on the inlet 120 may be different from the wave propagation directions in even-numbered channels, whereas the wave propagation directions in the odd-numbered channels may be equal to each other and the wave propagation directions in the even-numbered channels may be equal to each other.

FIG. 1 illustrates the coiling unit 130 where the space is coiled up by 7 channels. In particular, the coiling unit 130 may include several types of channels: the inlet channel 150 that connects one end thereof with the inlet 120 to guide the wave propagation in a first direction, a first intermediate channel 170*a* that connects one end thereof with the inlet channel 150 to guide the wave propagation in a second direction, a second intermediate channel 170*b* that connects one end thereof with the first intermediate channel 170*a* to guide the wave propagation in a third direction, a third intermediate channel 170*c* that connects one end thereof with the second intermediate channel 170*b* to guide the wave propagation in a fourth direction, a fourth intermediate channel 170*d* that connects one end thereof with the third intermediate channel 170*c* to guide the wave propagation in a fifth direction, a fifth intermediate channel 170*e* that connects one end thereof with the fourth intermediate channel 170*d* to guide the wave propagation in a sixth direction, and the output channel 160 that connects one end thereof with the fifth intermediate channel 170*e* and the other end thereof with the output unit 140 to guide the wave propagation in a seventh direction. The odd-numbered channels (i.e., the inlet channel 150, the second intermediate channel 170*b*, the fourth intermediate channel 170*d*, and the output channel 160) have waves with the same propagation direction. The even-numbered channels (i.e., the first intermediate channel 170*a*, the third intermediate channel 170*c*, and the fifth intermediate channel 170*e*) have waves with the same propagation direction. Although the wave propagation direction in odd-numbered channels is different from the wave propagation direction in even-numbered channels, a vector sum of the propagation directions of all the channels is consistent with the effective wave propagation direction. The channels illustrated in FIG. 1 are just based on one embodiment of the present inventive concept, and the number of channels or a wave propagation direction therein may vary depending on characteristics of the artificial atom 100. That is, a coiling degree or the like of a coiling unit may vary depending on the purpose to change the characteristics of waves. Herein, a coiling degree of a coiling unit may be determined by the number of channels changing wave propagation directions, that is, the number of changes in the wave propagation directions or a total distance of the wave propagation.

In the artificial atom 100, when a straight distance between the inlet 120 and the output unit 140 is referred to as a lattice constant a, a width d of the channels may be smaller than the lattice constant a and also may be narrower than a wavelength of the waves. For example, the width d of the channel may be 0.081 times of the lattice constant a.

The waves propagating in the coiling unit 130 may propagate along a zigzag path so that the incident waves in the artificial atom 100 may be able to propagate a longer distance than the lattice constant a. For example, a length of the pathway of the waves formed by the coiling unit 130 may be 4.2 times or longer than a lattice constant a.

In addition, in order to minimize a volume of the artificial atom 100, the neighboring channels in the plurality of channels may be separated by one plate 180 and the plate 180 may be in the form of a narrow thin film. The plate 180 may be formed of a solid material such as metal like brass or polymer. A length L of the plate 180 may be shorter than a lattice constant a. For example, the length L of the plate 180 may be 0.61 times the lattice constant a. In addition, it is desirable to have a narrow plate in width in comparison to the lattice constant a. For example, the width of the plate 180 may be 0.02 times the lattice constant a.

The artificial atom 100 illustrated in FIG. 1 may include one coiling unit and accordingly, waves such as acoustic waves or electromagnetic waves may have one effective wave propagation direction via the artificial atom 100. Therefore, the artificial atom 100 illustrated in FIG. 1 may be referred as a one-dimensional artificial atom. Such one-dimensional artificial atoms may be disposed to form a metamaterial. The one-dimensional artificial atoms may be disposed in one, two, or three dimensions. Depending on the form of an array of one-dimensional artificial atoms, a metamaterial emits the incident waves by changing the characteristics of the waves.

Figure 2A:
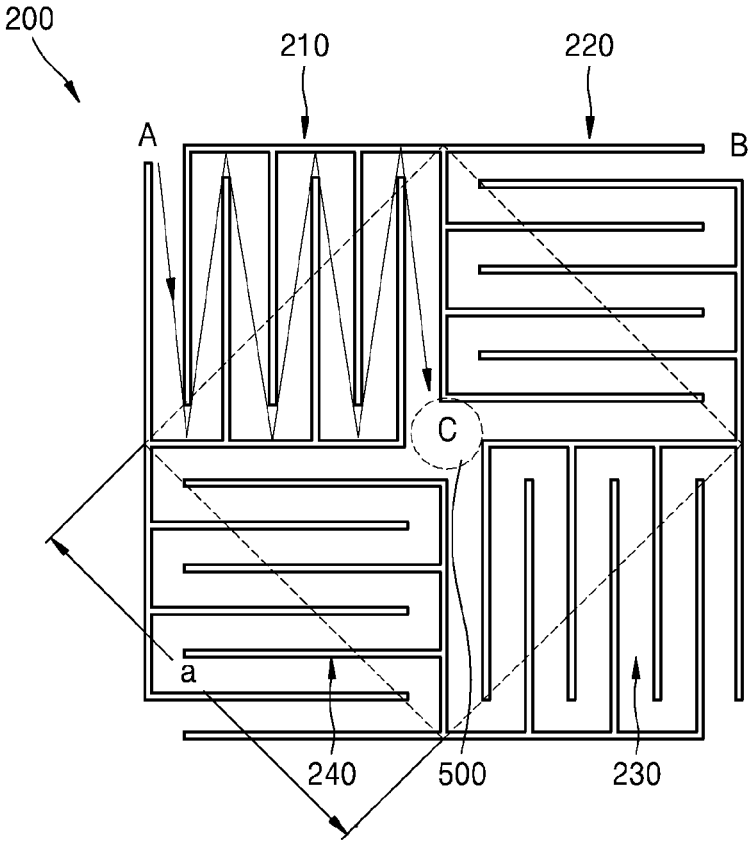
FIG. 2A is a view illustrating a two-dimensional artificial atom, according to an embodiment of the present inventive concept.

Also, the artificial atoms in the metamaterial may include a plurality of coiling units, wherein wave propagation directions are different. FIG. 2A is a view illustrating a two-dimensional artificial atom, according to an embodiment of the present inventive concept. As shown in FIG. 2A, a two-dimensional artificial atom 200 may be formed by connecting a plurality of coiling units having different effective wave propagation directions in the two-dimensional plane.

For convenience of description, FIG. 2A illustrates 4 coiling units 210, 220, 230, and 240 that are interconnected to each other. However, the two-dimensional artificial atom is not limited thereto, and may be formed by connecting at least 2 coiling units. For convenience of description, it will be described about changes in the characteristics of the waves in the case of 4 interconnected coiling units.

As described above, each of coiling units 210, 220, 230, and 240 coils up the space, and thus the waves propagate along a zigzag path. The coiling units 210. 220. 230, and 240 may coil up the space in two or three dimensions.

One end of each of the coiling units, namely first, second, third, and fourth coiling units 210, 220, 230, and 240, is disposed at the center c of the two-dimensional artificial atom 200 to be interconnected to each other. The first, second, third, and fourth coiling units 210, 220, 230, and 240 may be disposed to be rotationally symmetric about the center point c.

For example, the first to the fourth coiling units 210, 220, 230, and 240 may be disposed in a way the first coiling unit 210 corresponds to the second coiling unit 220 if rotated 90° relative to the center point c. Likewise, the second coiling unit 220 corresponds to the third coiling unit 230 if rotated 90° relative to the center point c, and the third coiling unit 230 corresponds to the fourth coiling unit 240 if rotated 90° relative to the center point c. Also, the fourth coiling unit 240 corresponds to the first coiling unit 210 if rotated 90° relative to the center point c. Therefore, the first coiling unit 210 is diagonally symmetrical to the third coiling unit 230 about the center point c, and the second coiling unit 220 is diagonally symmetrical to the fourth coiling unit 240

Therefore, the effective propagation of waves in the first coiling unit 210 may be equal to that in the third coiling unit 230. Likewise, the effective propagation of waves in the second coiling unit 220 may be equal to that in the fourth coiling unit 240.

Thereby, the incident wave in the two-dimensional artificial atom 200 may be emitted to the outside of the artificial atom 200 via at least one of the 4 coiling units 210, 220, 230, and 240. For example, the incident waves coming from the outside of the artificial atom 200 through the first coiling unit 210 may propagate within the first coiling unit 210 and then may be dispersed from the center point c to the second, third, and fourth coiling units 220, 230, and 240. Accordingly, the dispersed waves may propagate within each coiling unit to then be emitted to the outside. Depending on the characteristics of the incident waves, the waves may be dispersed to all of the second, third, and fourth coiling units 220, 230, and 240, or may be dispersed to some of the coiling units 220, 230, and 240.

Figure 2B:
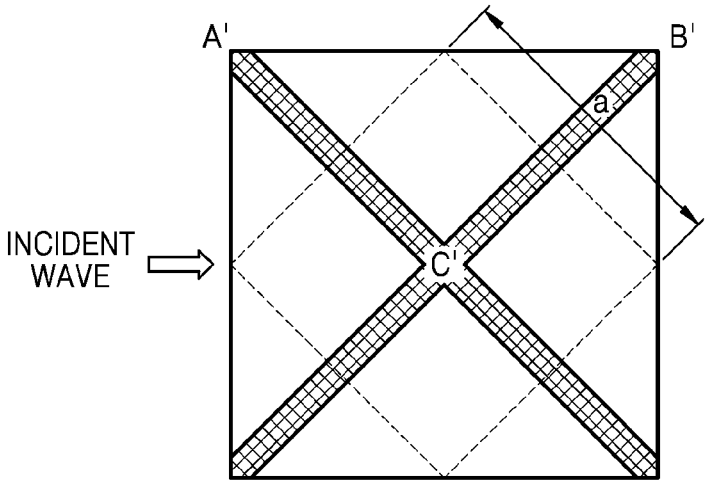
FIG. 2B is a view illustrating a simplified coiling effect of the two-dimensional artificial atom of 2A.

FIG. 2B is a view illustrating an evenly simplified channel formation to describe a coiling effect of the two-dimensional artificial atom of FIG. 2A. That is, the "X"-shaped region in FIG. 2B represents regions of the channels equivalent to the coiling channels, and the rest of the regions represents plates forming the channels. Herein, a refractive index $n_{0r}$ in the "X"-shaped region of the channel may be defined by dividing the wave speed passing through the inlet of the coiling unit to the outlet of the coiling unit in the absence of the channels by the wave speed passing through the coiling unit from the inlet to the outlet. For example, when a length of the wave propagation by the coiling unit is 4.2 times the straight-line distance between the inlet and the outlet, the refractive index $n_{0r}$ is 4.2. A high refractive index and an elapsed phase of the corresponding wave may be achieved by providing curvatures as much as desired on the channels. The metamaterial based on the artificial atom units by coiling up as may operate effectively without causing a diffraction effect for low-frequency acoustic waves. Therefore, a size of a device that controls acoustic waves may be reduced by using the corresponding metamaterial.

Hereinafter, the dispersion relations (i.e., the relationship between frequency and frequency vector) in the two-dimensional artificial atom 200 will be described. By applying the Floquet-Bloch theory, the dispersion relation may be approximately obtained as Equation 1 below.

$$\cos \Phi_{C'A'} + \cos \Phi_{C'B'} = 2\cos(n_{or2} k_0 a) \quad \text{<Equation 1>}$$

where $\Phi_{C'A'}$ and $\Phi_{C'B'}$ represent the elapsed phase of a Bloch wave in the C'A' and C'B' directions, respectively in FIG. 2B. In Equation 1, $k_0$ represents the number of the acoustic waves, and $n_{or2}$ represents the refractive index of the first and the second coiling units 210 and 220. The coiling units in the two-dimensional artificial unit show in FIG. 2A are rotationally symmetric about the center point c so that the refractive indices of the coiling units are consistent with each other.

Equation 1 represents the dispersion relation and the band folding. Since the two-dimensional artificial atom coils up the space with the same factor $n_{or}$ in both the C'A' and C'B' directions, equi-frequency contours (EFCs) are very close to a circle near the Γ point (that is, $\cos \Phi_{C'A'} = \cos \Phi_{C'B'} = 0$). This generates an isotropic refractive index for the two-dimensional artificial atom 200 of FIG. 2A. The normalized frequency $\omega a/(2\pi c)$ (where ω is each frequency of acoustic waves, c is acoustic wave speed in aft) at the Γ point may be found as integral multiples of $1/n_{0r2}$.

Therefore, the position of the band in the frequency range may be tuned by $n_{0r2}$ or the path length of the acoustic waves in the coiling units. A longer path length is equivalent to a higher refractive index $n_{0r2}$. This generates a formation of a two-dimensional artificial atom to have band folding at low enough frequencies, and the metamaterials formed of the two-dimensional artificial atom may be still described with both effective density and effective bulk modulus near the Γ point.

Figure 3A:
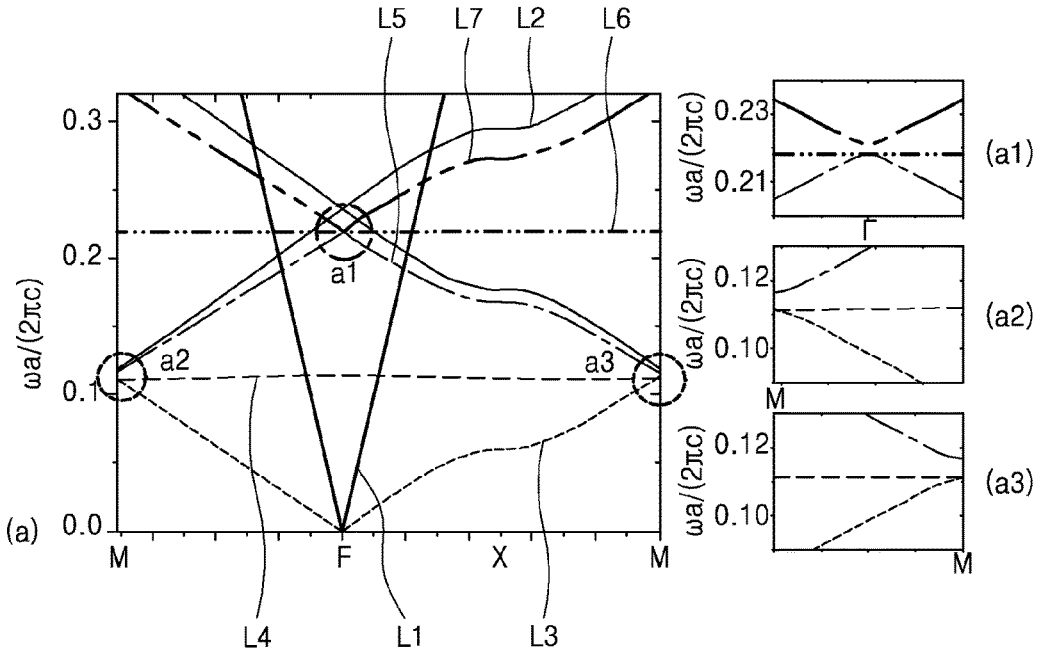
FIG. 3A is a view illustrating a band structure of the two-dimensional artificial atom of FIG. 2A (illustrating a relationship between a frequency and a wave vector)

FIG. 3A is a view illustrating a band structure (the relationship between frequency and wave vector) of the two-dimensional artificial atom 200 of FIG. 2A, and FIG. 3B to 3D are views illustrating Equi-Frequency Contours (EFCs) of the first to third bands of FIG. 3A.

In FIG. 3A, a first solid line L1 represents characteristics of the wave in air, and a second solid line L2 represents a band structure of the two-dimensional artificial atom 200 obtained by Equation 1. Dashed curve lines L3 to L7 represent the results obtained numerically through DMS simulation. The first to the fifth bands L3 to L7 are formed from low frequency to high frequency. The slopes of the second and the fourth bands L4 and L6 near the frequencies 0.11 and 0.22 are flat to almost zero.

Figure 3B:
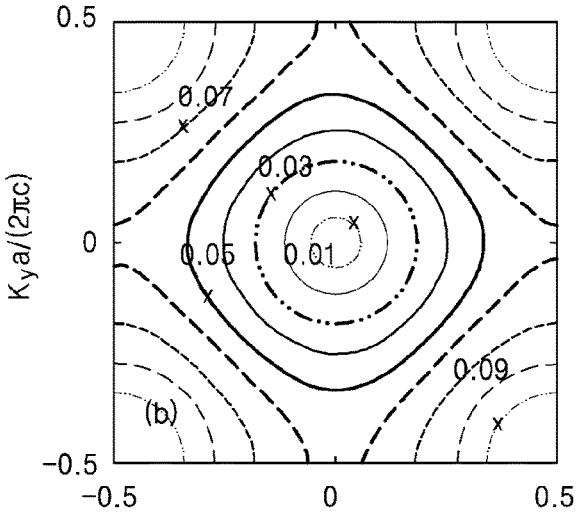
FIGS. 3B to 3D are views illustrating Equi-Frequency Contours (EFCs) of the first to third bands of FIG. 3A.
Figure 3C:
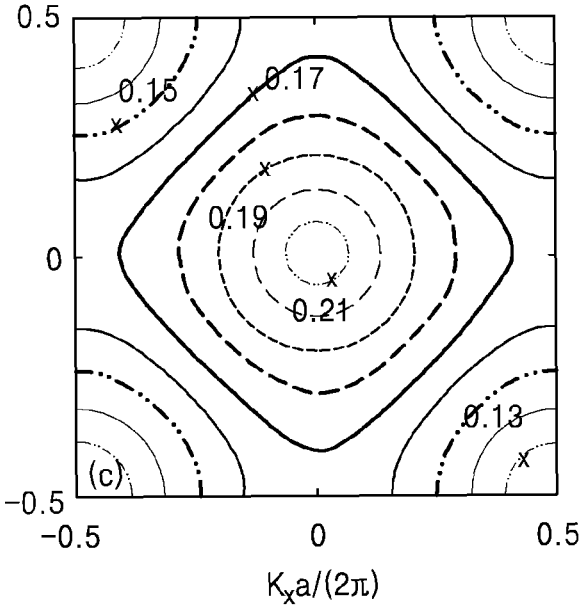
Figure 3D:
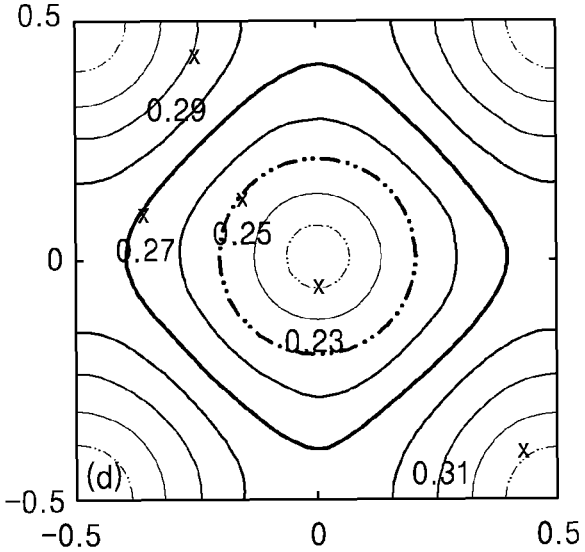

The Γ X direction of FIG. 3A corresponds to the CB direction of FIG. 2A. Except for a small frequency shift due to the finite width of the regions, which represent circles a1, a2, and a3 at the Γ X position, and of the channel within each coiling unit in the two-dimensional artificial atom, the band structure of the simulation is almost similar to the band structure of Equation 1. At lower frequencies, the channel width is much smaller than the wavelength, and thus it confirms that the two band structures, which are obtained by the simulation and Equation 1, coincide with each other. The slopes of the dispersion relations around the Γ point in both the ΓX and ΓM directions are almost the same at the first, third, and fifth bands L3, L5, and L6 owing to band folding. This indicates that the refractive index of the two-dimensional artificial atom is an isotropic index. Thus, it was confirmed that the three bands having frequencies $\omega a/(2\pi c)$ from 0 to 0.04, from 0.18 to 0.218, from 0.22 to 0.26 as illustrated in FIGS. 3B to 3D are almost circular with variations in radius within 5%. The different relative indexes may then be extracted from the size of the EFCs, comparing to the dispersion relations in the aft (black solid line).

At the third band L5, a negative refractive index from 0 to −1 may be obtained, and at the fifth band L7, a refractive index smaller than 1 may be obtained. There is a flat band around $\omega a/(2\pi c) = 0.219$ at the edge of the band gap. The mode of the acoustic waves in this flat band is transverse in nature. Thus, such modes may not be exited by incident plane waves of longitudinal modes.

In addition, by calculating the complex reflection and transmission coefficients of the two-dimensional artificial atom 200, the relative effective refractive index $n_r$ and relative effective impedance $Z_r$ of the above-mentioned bands may be calculated. Due to the lack of local resonance, material absorption losses are not amplified near the resonance frequency.

Figure 4A:
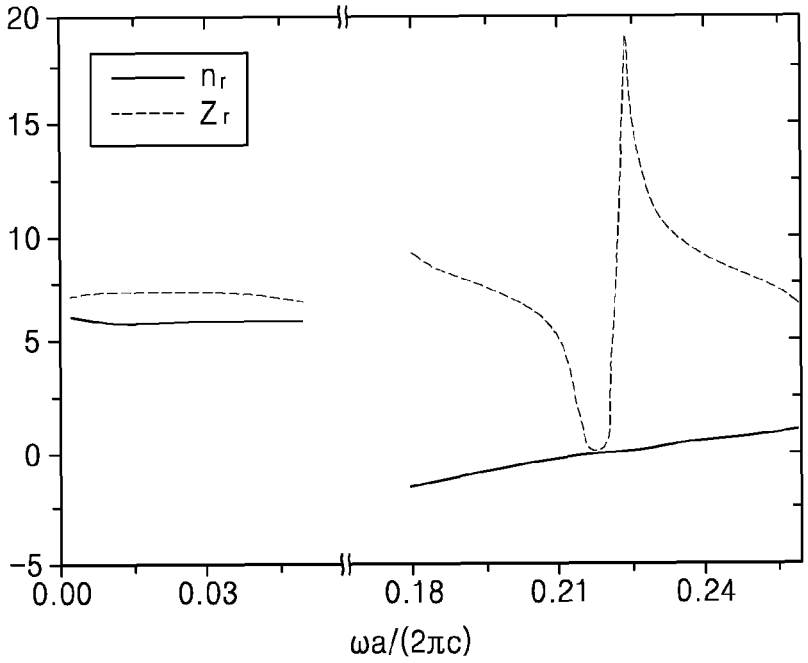
FIG. 4A is a graphical view illustrating relative effective refractive index (solid line) and relative effective impedance (dashed line), according to the frequency of the two-dimensional artificial atom of FIG. 2A.
Figure 4B:
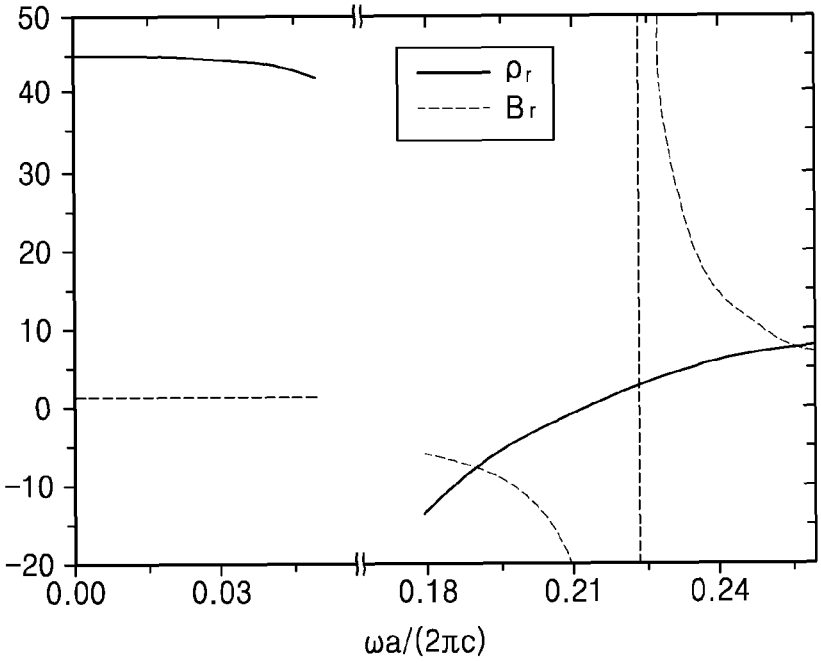
FIG. 4B is a graphical view illustrating effective density (solid line) and effective bulk modulus (dashed line), according to the frequency of the two-dimensional artificial atom of FIG. 2A.

FIG. 4A is a graphical view illustrating relative effective refractive index (solid line) and relative effective impedance (dashed line), according to frequency of the two-dimensional artificial atom 200 of FIG. 2A. FIG. 4B is a graphical view illustrating effective density (solid line) and effective bulk modulus (dashed line), according to frequency of the two-dimensional artificial atom 200 of FIG. 2A. The relative effective index shown in FIG. 4A is the same as the relative effective refractive index shown in FIG. 3A. The effective density and effective bulk modulus shown in FIG. 4B may be obtained by $\rho_r = n_r Z_r$ and $B_r = Z_r/n_r$, respectively.

At the low frequency region having longer wavelength compared to the lattice constant a of the artificial atom, $\rho_r$ and $B_r$ may simply be constants. For example, $B_r = 1/(1-f) = 1.23$ where $f = 0.19$ is the filling ratio (FR), and the relative effective density $\rho_r = n_r^2 B_r = 44.3$ when $n_r = 6$ is obtained. The two-dimensional artificial atom disclosed in the present specification is effective at achieving a high refractive index which is rare in nature. For example, when the frequency range is from 0.18 to 0.26, $\rho_r$ changes from negative to positive and crosses zero at $\omega a/(2\pi c) = 0.218$, which is the lower edge of the band gap. Meanwhile. $1/B_r$ also changes from negative to positive in a similar way and crosses zero at $\omega a/(2\pi c) = 0.22$, which is the upper edge of the band gap. Below the band gap, there is a frequency region of all negative $\rho_r$, $B_r$, and $n_r$ at the same time. In order to have both negative $\rho_r$ and $B_r$ at the same time (double negative), contrary to the conventional approaches in overlapping two different kinds of resonances to create double negativity, the space is coiled up to give a large enough $n_{0r}$.

In FIG. 2A, a two-dimensional artificial atom is formed of 4 rotationally symmetric coiling units, but a two-dimensional artificial atom is not limited thereto. For example, it is also possible to form a two-dimensional artificial atom by 2 rotationally symmetric coiling units. In addition, a two-dimensional artificial atom may be formed of a plurality of coiling units that are not symmetric or that have different coiling degrees. That is, anisotropy coiling units may be combined to form a two-dimensional artificial atom. A disposition relation between coiling units or a degree of each coiling unit may vary depending on the purpose of changing the characteristics of the waves. That is, a disposition relation between coiling units or a degree of each coiling unit may vary material coefficients (i.e., refractive index, impedance, modulus, density, etc).

Figure 5:
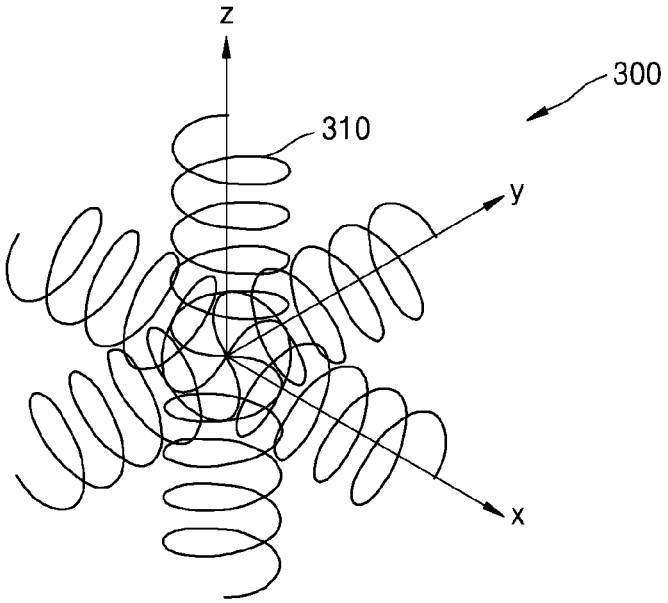
FIG. 5 is a view schematically illustrating a three-dimensional artificial atom according to an embodiment of the present inventive concept.

FIG. 5 is a view schematically illustrating a three-dimensional artificial atom according to an embodiment of the present inventive concept.

A three-dimensional artificial atom 300 may be formed by connecting a plurality of coiling units 310 in three dimensions in which each coiling unit has different effective wave propagation. In FIG. 5, the curves represent the coiling units. For example, 6 coiling units 310 may be interconnected to each other to form the three-dimensional artificial atom 300. The coiling units 310 may coil up the space in two or three dimensions.

Each coiling unit 310 is connected with the center of the artificial atom 300, and each coiling unit may be corresponded to a neighboring coiling unit when rotated 90° relative to the center point. Also, the effective wave propagation directions of each coiling unit 310 may not exist in the two-dimensional plane. As described above, the disposition relation between coiling units or a degree of each coiling unit may vary depending on the purpose of changing the characteristics of the waves.

A metamaterial may be formed by disposing the above-described artificial atoms. In detail, a metamaterial may be formed by disposing one-dimensional artificial atoms in one dimension, two dimensions, or three dimensions, or by disposing two-dimensional artificial atoms in one dimension, two dimensions, or three dimensions. Likewise, a metamaterial may be formed by disposing three-dimensional artificial atoms in one dimension, two dimensions, or three dimensions. In addition, a metamaterial may be formed by connecting at least two of the one-dimensional, two-dimensional, and three-dimensional artificial atoms and then disposing them in one dimension, two dimensions, or three dimensions.

A metamaterial may be isotropic or anisotropic by adjusting a degree of coiling units included in the artificial atom. When the coiling units coil up the space and the metamaterial has a high refractive index, the artificial atom may operate at frequencies having low effective density and low volume modulus. Thus, a metamaterial may reduce the loss of the waves in comparison with conventional metamaterial using local resonance to obtain a double negativity, an effective density close to zero, and a positive refractive index. Also, a device that changes the characteristics of the waves by the metamaterial of the present inventive concept may be manufactured.

For example, an acoustic prism that has negative effective density and negative effective bulk modulus may be constructed using the metamaterial.

Figure 6:
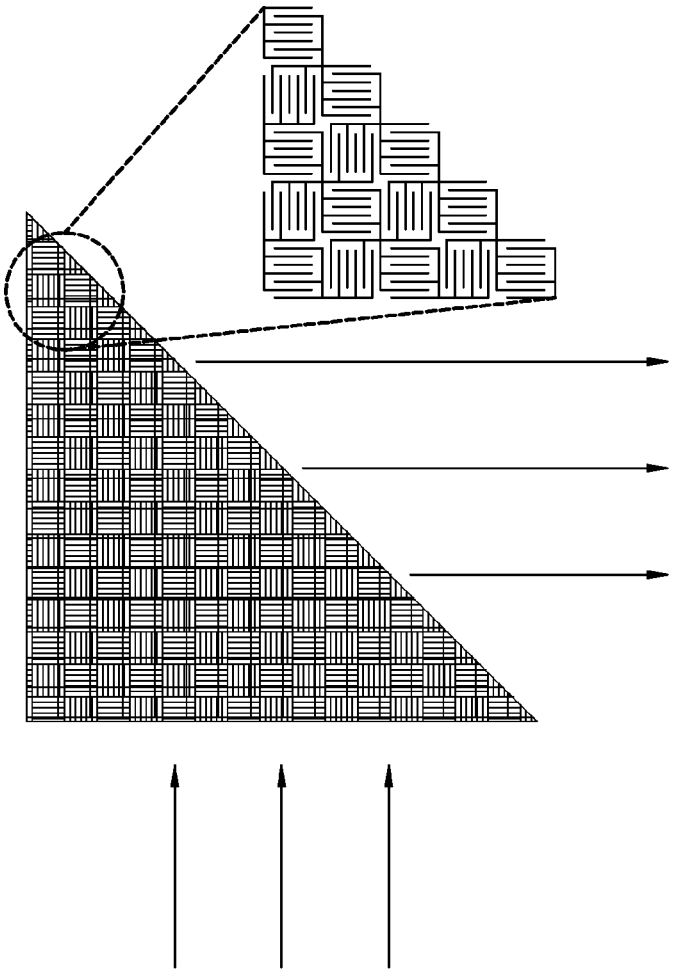
FIG. 6 is a view illustrating a prism constructed using the same structures of the one-dimensional artificial atom shown in FIG. 1 and the two-dimensional artificial atom shown in FIG. 2.

FIG. 6 is a view illustrating a prism constructed using the same structures of the one-dimensional artificial atom shown in FIG. 1 and the two-dimensional artificial atom shown in FIG. 2. As illustrated in FIG. 6, a prism with an angle of inclination of 45° may be formed by disposing the one-dimensional and two-dimensional artificial atoms in two dimensions. Then, an acoustic beam with an amplitude distribution in the form of a Gaussian beam of width 15.4 a with a chosen normalized frequency $\omega a/(2\pi c)=0.191$ in a vacuum enters from the bottom of the prism. The two-dimensional artificial atom has a relative effective refractive index $n_r=-1$ at the normalized frequency so that the beam undergoes negative refraction and exits the prism.

As another example, an artificial atom may have a density near to zero at a very low frequency as described above. Thus, when metamaterials formed of the artificial atoms are disposed within a waveguide, waves may cause a tunneling phenomenon within the waveguide.

Figure 7A:
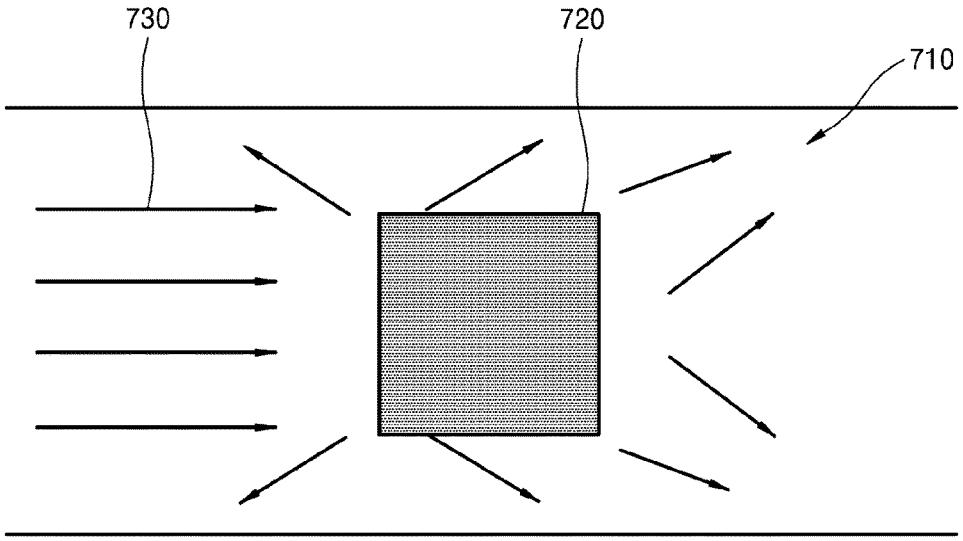
FIG. 7A shows a result of a pattern simulation of a pressure field of waves when a solid plate blocking more than half of a width of a waveguide is inserted.

FIG. 7A is shows a result of a pattern simulation of a pressure field of waves when a solid plate blocking more than half of a width of a waveguide is inserted. As illustrated in FIG. 7A, a solid plate 720 is inserted in the middle of a waveguide 710, and plane acoustic waves 730 enter from left to right of the waveguide 710. Because the solid plate 720 blocks more than half of the width of the waveguide 710, the plane acoustic waves 730 are scattered severely.

Figure 7B:
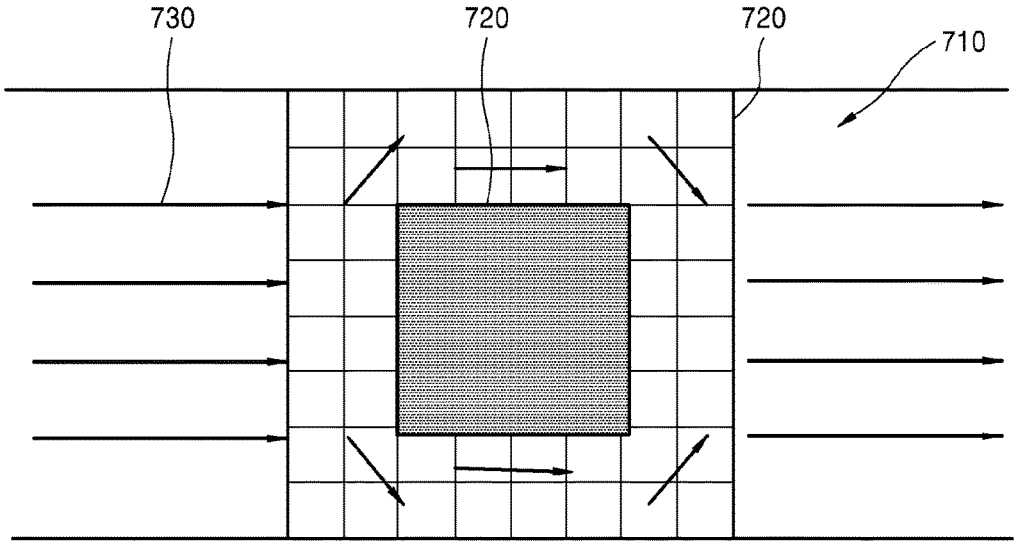
FIG. 7B shows a result of a pattern simulation of a pressure field of waves when metamaterials, according to an embodiment of the present inventive concept, are disposed around the solid plate of FIG. 7A.

FIG. 7B shows a result of a pattern simulation of a pressure field of waves when metamaterials according to an embodiment of the present inventive concept are disposed around the solid plate 720 of FIG. 7A. The metamaterials of FIG. 7B may be formed by disposing the two-dimensional artificial atoms in two dimensions.

As illustrated in FIG. 7B, the scatterer solid plate 720 may be enclosed by metamaterials 740. In both simulations, a frequency of the incident wave 730 within the waveguide 710 is a frequency $\omega a/(2\pi c)=214$, which is smaller than the frequency of the lower edge of the band gap where the relative effective density is zero. The small relative effective density $\rho_r=-0.1$ together with the large relative bulk modulus $_{Br}=-33$ implies the occurrence of tunneling. In FIG. 7B, it was confirmed that the plane waves may be maintained without scattering when passing through the solid plate 720 enclosed by the metamaterials.

Figure 8:
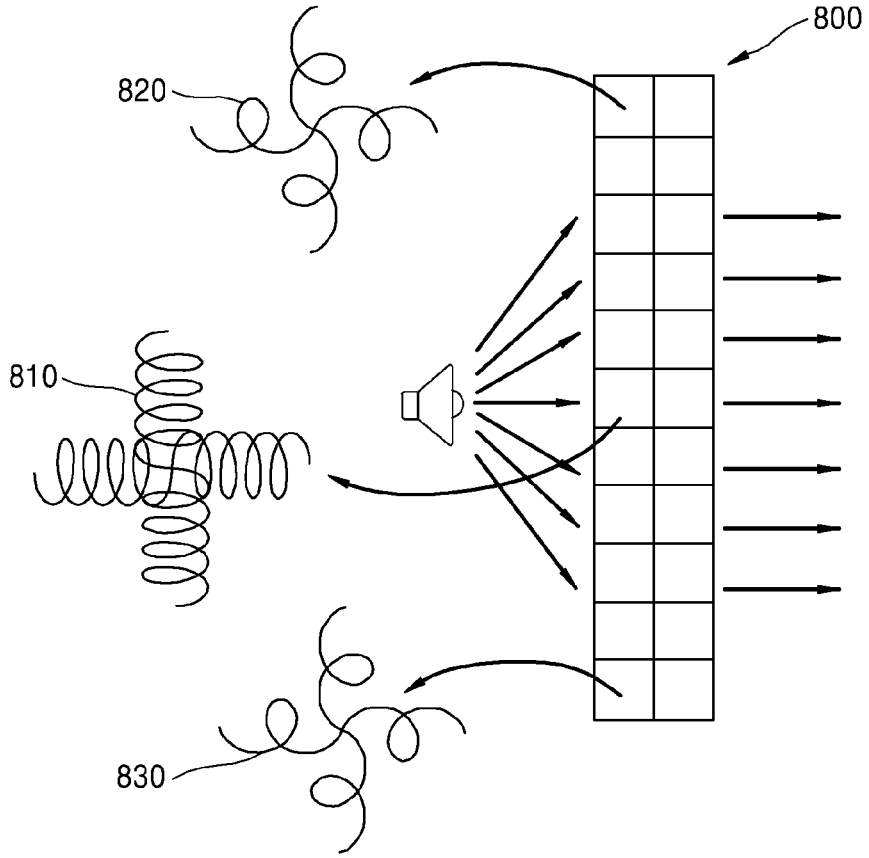
FIG. 8 is a view illustrating a lens formed of metamaterials according to an embodiment of the present inventive concept.

FIG. 8 is a view illustrating a lens formed of metamaterials according to an embodiment of the present inventive concept.

As illustrated in FIG. 8, a lens 800 may be formed by disposing a plurality of two-dimensional artificial atoms 810, 820, and 830 in two dimensions. The two-dimensional artificial atom 810 with a large degree of coiling units may be disposed at the center of the lens 800, and other two-dimensional artificial atoms 820 and 830 of which a degree of coiling units decreases toward the edge of the lens 800 may be disposed at the edges. Thus, a plurality of two-dimensional artificial atoms in which a degree of coiling units gradually changes from the center to the edges of the lens 800 may be formed. The lens 800 may have a refractive index gradually changing from the center to the edges of the lens 800.

The above-mentioned metamaterial controls not only acoustic waves, but also elastic waves or electromagnetic waves. Therefore, a device changing the characteristics of elastic waves or electromagnetic waves may be manufactured by the metamaterial.

It should be understood that the exemplary embodiments described therein should be considered in a descriptive sense only and not for purposes of limitation. Descriptions of features or aspects within each embodiment should typically be considered as available for other similar features or aspects in other embodiments.

The invention claimed is:

1. An artificial atom forming a metamaterial, comprising:

a first coiling unit comprising first channels that are parallel to each other and arranged in a first direction, one of the first channels being an output channel which outputs a wave propagating through the first channels to a point; and a second coiling unit connected with the first coiling unit and comprising second channels that are parallel to each other and arranged in a second direction different from the first direction, one of the second channels being an input channel which inputs a wave propagating through the second channels from the point.

2. The artificial atom forming a metamaterial of claim 1, wherein the wave in at least one of the first coiling unit and the second coiling unit propagates along a zigzag path.

3. The artificial atom forming a metamaterial of claim 2, wherein the first channels are connected in series.

4. The artificial atom forming a metamaterial of claim 3, wherein wave propagation directions of neighboring channels in the first channels are different.

5. The artificial atom forming a metamaterial of claim 3, wherein neighboring channels of the first channels are separated by a plate.

6. The artificial atom forming a metamaterial of claim 3, wherein each of the first channels has a width that is smaller than a wavelength of the wave propagating through the first channels.

7. The artificial atom forming a metamaterial of claim 3, wherein the first channels of the first coiling unit and the second channels of the second coiling unit are connected to each other in series.

8. The artificial atom forming a metamaterial of claim 1, wherein the waves are at least one of an acoustic wave, an electromagnetic wave, and an elastic wave.

9. The artificial atom forming a metamaterial of claim 1, wherein at least one of the first coiling unit and the second coiling unit are coiled up in at least one of two or three dimensions.

10. The artificial atom forming a metamaterial of claim 1, wherein the first coiling unit and the second coiling unit are connected to each other at the point and the first coiling unit and the second coiling unit are rotationally symmetric about the point.

11. The artificial atom forming a metamaterial of claim 1, wherein the first coiling unit and the second coiling unit are anisotropic.

12. The artificial atom forming a metamaterial of claim 1, wherein the first coiling unit and the second coiling unit are isotropic.

13. The artificial atom forming a metamaterial of claim 1, further comprising:

a third coiling unit that is connected with the first coiling unit and the second coiling unit; and a fourth coiling unit that is connected with the first coiling unit, the second coiling unit, and the third coiling unit.

14. The artificial atom forming a metamaterial of claim 13, wherein the first coiling unit, the second coiling unit, the third coiling unit, and the fourth coiling unit are interconnected to each other at the point which is at a center of the artificial atom.

15. The artificial atom forming a metamaterial of claim 13, wherein the artificial atom is isotropic.

16. The artificial atom forming a metamaterial of claim 13, wherein a refractive index of the artificial atom is proportional to a length that one of the waves propagates through the artificial atom.

17. The artificial atom forming a metamaterial of claim 16, wherein the refractive index is 4 or more.

18. The artificial atom forming a metamaterial of claim 13, wherein at least one of an effective density and effective bulk modulus of the artificial atom with regard to a wave of a specific frequency band is negative.

19. The artificial atom forming a metamaterial of claim 18, wherein a refractive index with regard to the wave of a specific frequency band is negative.

20. The artificial atom forming a metamaterial of claim 13, wherein a lattice constant of the artificial atom is smaller than a wavelength of one of the waves.

21. The artificial atom forming a metamaterial of claim 13, wherein the third coiling unit and the fourth coiling unit are rotationally symmetric based on the point connecting the third coiling unit and the fourth coiling unit to each other.

22. The artificial atom forming a metamaterial of claim 1 further comprising a third coiling unit that is connected with the first coiling unit and the second coiling unit, wherein the first coiling unit, the second coiling unit, and the third coiling unit are rotationally symmetric to each other about the point.

23. A metamaterial formed of a plurality of the artificial atom of claim 1.

24. The metamaterial of claim 23, wherein the plurality of the artificial atom are formed in at least one of one dimension, two dimensions, and three dimensions.

25. A lens comprising the metamaterial of claim 23, wherein the lens is configured to change characteristics of an incident wave by the metamaterial.

26. An artificial atom forming a metamaterial, the artificial atom comprising:

an inlet configured to receive an incident wave;

an outlet configured to output the incident wave; and a coiling unit configured to propagate the incident wave along a zigzag path from the inlet toward the outlet, wherein a refractive index of the artificial atom is proportional to a length of the zigzag path.

27. The artificial atom forming a metamaterial of claim 26, wherein the coiling unit comprises a plurality of channels connected in series through which the incident wave propagates.

28. The artificial atom forming a metamaterial of claim 27, wherein a vector sum of wave propagations is proportional to propagation directions of the incident wave from the inlet to the outlet.

29. An artificial atom forming a metamaterial comprising:

an inlet configured to receive an incident wave;

an outlet configured to output the wave; and a coiling unit that is connected from the inlet to the outlet and configured to propagate the wave along a path from the inlet to the outlet, wherein a length of the path in the coiling unit is longer than a straight-line distance between the inlet and the outlet, and wherein a refractive index of the artificial atom is proportional to the length of the path.

* * * * *